US009858846B2

(12) United States Patent
Jin

(10) Patent No.: US 9,858,846 B2
(45) Date of Patent: Jan. 2, 2018

(54) METHOD OF RGBW COMPENSATION BASED ON COLOR ABERRATIONS OF WHITE SUBPIXELS AND APPARATUS THEREOF

(71) Applicant: Shenzhen China Star Optoelectronics Technology Co., Ltd., Shenzhen, Guangdong (CN)

(72) Inventor: Yufeng Jin, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 206 days.

(21) Appl. No.: 14/898,275

(22) PCT Filed: Sep. 21, 2015

(86) PCT No.: PCT/CN2015/090138

§ 371 (c)(1),
(2) Date: Dec. 14, 2015

(87) PCT Pub. No.: WO2017/045214

PCT Pub. Date: Mar. 23, 2017

(65) Prior Publication Data

US 2017/0256190 A1 Sep. 7, 2017

(30) Foreign Application Priority Data

Sep. 17, 2015 (CN) ..... 2015 1 0593712

(51) Int. Cl.
*G09G 5/02* (2006.01)
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2300/0452* (2013.01);
(Continued)

(58) Field of Classification Search
None
See application file for complete search history.

(56) References Cited

U.S. PATENT DOCUMENTS 8,780,133 B2 * 7/2014 Jeong ..... G09G 5/02 345/590
2010/0315449 A1 12/2010 Chaji et al.
(Continued)

FOREIGN PATENT DOCUMENTS

CN 103147223 A 4/2014
KR 20140122119 A 10/2014

*Primary Examiner* — Xiao Wu
*Assistant Examiner* — Mohammad H Akhavannik
(74) *Attorney, Agent, or Firm* — Andrew C. Cheng

(57) ABSTRACT

The present invention discloses a method of RGBW compensation based on color aberrations of white subpixel and an apparatus thereof: when aberrations exist between a color coordinate point $W_s$ of white subpixel and a standard white color coordinate point $W_d$ under sRGB, analyzing color coordinates of every subpixel on the RGBW panel, and then dividing a triangle with vertices points $R_s$, $G_s$ and $B_s$ into three triangle regions based on $W_s$ as the center point; based on ranges of the three triangle regions, a triangle region where $W_d$ is located is confirmed; a first data is calibrated by performing compensating the white subpixel corresponding by the center point $W_s$ via a predetermined normalized proportion through two subpixels corresponding to the other two points within the triangle region surrounding and locating $W_d$. Through the aforementioned manner, the present invention is capable of calibrating aberrations of white subpixels in order to normalize images of RGBW panels.

4 Claims, 6 Drawing Sheets

(52) U.S. Cl.
CPC ..... *G09G 2320/0666* (2013.01); *G09G 2320/0693* (2013.01); *G09G 2360/16* (2013.01)

(56) References Cited

U.S. PATENT DOCUMENTS

| | | | |
|---|---|---|---|
| 2013/0222414 | A1 | 8/2013 | Ito et al. |
| 2014/0267442 | A1 | 9/2014 | Lin et al. |
| 2015/0154762 | A1 | 6/2015 | Yang et al. |
| 2016/0253942 | A1 | 9/2016 | Tseng et al. |
| 2016/0293082 | A1 | 10/2016 | Zhang et al. |

* cited by examiner

METHOD OF RGBW COMPENSATION BASED ON COLOR ABERRATIONS OF WHITE SUBPIXELS AND APPARATUS THEREOF

TECHNICAL FIELD

The present invention relates to a display technology field, and particularly to a method of RGBW compensation based on color aberrations of white subpixels and an apparatus thereof.

BACKGROUND

With strengthening of people's awareness of energy conservation, energy consumptions of products gradually turn into an important factor of product. Under a motivation of awareness of energy conservation, developments of RGBW come afterwards. LG Display added white subpixel based on RGB foundation inventively to form RGBW 4K. Light transmittance of panels of RGBW 4K is increasing apparently with participation of white subpixel, and luminance of panel increases 1.5 times based on the foundation of panels of traditional RGB 4K.

Nowadays, a variety of algorithms exists in switching from RGB signals to RGBW signals, and comprises traditional algorithms and new algorithms in research. However, after applying those algorithms to switch RGB signals into RGBW signals particularly in Organic Light Emitting Display (OLED), aberrations are found between color coordinate points of actual white subpixels (W-subpixel) and standard white color coordinate points under sRGB; the white subpixels have larger color aberrations.

DISCLOSURE OF INVENTION

A technical problem mainly solved in the present invention is to provide a method of RGBW compensation based on color aberrations of white subpixel and an apparatus thereof in order to normalize images of RGBW panels and be capable of calibrating aberrations of white subpixels.

To solve the aforementioned technical problem, a technical solution applied in the present invention is: a method of RGBW compensation is provided based on color aberrations of white subpixels, aberrations exist between a color coordinate point $W_s$ of white subpixels of image pixels on a RGBW panel and a standard white color coordinate point $W_d$ under sRGB before compensating, and the method comprises: inserting the image pixels based on a first data of RGBW color space; analyzing color coordinates of every subpixel of the image pixels on the RGBW panel, and then dividing a triangle $R_sG_sB_s$ with vertices color coordinate points $R_s$, $G_s$, and $B_s$ of red subpixel, green subpixel and green pixel of the image points into three triangle regions, $R_sG_sW_s$, $R_sB_sW_s$, $B_sG_sW_s$, based on taking the color coordinate point $W_s$ as the center point; confirming a triangle region where the color coordinate point is located based on ranges of the three triangle regions, $R_sG_sW_s$, $R_sB_sW_s$, $B_sG_sW_s$; performing compensating the white subpixel corresponding by the center point $W_s$ via a predetermined normalized proportion to calibrated the first data through two subpixels corresponding to the other two color coordinate points, except the center point $W_s$, within the triangle region surrounding and locating the color coordinate point $W_d$; exporting the post-compensated a second data of image pixels based on the RGBW color space;

wherein, steps of performing compensating the white subpixel corresponding by the center point $W_s$ via a predetermined normalized proportion through two subpixels corresponding to the other two color coordinate points, except the center point $W_s$, within the triangle region surrounding and locating the color coordinate point comprises: if the color coordinate point $W_d$ is located within the triangle region $B_sG_sW_s$, a normalized proportion calculating a luminance among subpixel, the blue subpixel, green subpixel and white subpixel, is $B_sY$, $G_sY$, $W_sY$, and $B_sY+G_sY+W_sY=1$; performing calibration process to the first data by applying the normalized proportion $B_sY$, $G_sY$, $W_sY$ to obtain a second data of image pixels based on the RGBW color space, $$R_{fo}(i)=R_o(i)$$

$$G_{fo}(i)=G_o(i)+W_o(i)*G_sY(i)$$

$$B_{fo}(i)=B_o(i)+W_o(i)*B_sY(i)'$$

$$W_{fo}(i)=W_o(i)*W_sY(i),$$

wherein, $R_o(i)$, $G_o(i)$, $B_o(i)$, $W_o(i)$ is a first data of a pixel point i, $R_{fo}(i)$, $G_{fo}(i)$, $B_{fo}(i)$, $W_{fo}(i)$ is a second data of the pixel point i, $B_sY(i)$, $G_sY(i)$, $W_sY(i)$ is a normalized proportion of a luminance among a blue subpixel, green subpixel and white subpixel of the pixel point i;

if the color coordinate point $W_d$ is located within the triangle region $B_sR_sW_s$, a normalized proportion calculating a luminance among the blue subpixel, red subpixel and white subpixel, is $B_sY$, $R_sY$, $W_sY$, and $B_sY+R_sY+W_sY=1$;

performing calibration process to the first data by applying the normalized proportion $B_sY$, $R_sY$, $W_sY$ to obtain a second data of image pixels based on the RGBW color space, $$R_{fo}(j)=R_o(j)+W_o(j)*R_sY(j)$$

$$G_{fo}(j)=G_o(j)$$

$$B_{fo}(j)=B_o(j)+W_o(j)*B_sY(j)'$$

$$W_{fo}(j)=W_o(j)*W_sY(j),$$

wherein, $R_o(j)$, $G_o(j)$, $B_o(j)$, $W_o(j)$ is a first data of a pixel point j, $R_{fo}(j)$, $G_{fo}(j)$, $B_{fo}(j)$, $W_{fo}(j)$ is a second data of the pixel point j, $B_sY$ (j), $R_sY(j)$, $W_sY(j)$ is a normalized proportion of a luminance among a blue subpixel, red subpixel and white subpixel of the pixel point j;

if the color coordinate point $W_d$ is located within the triangle region $R_sG_sW_s$, a normalized proportion calculating a luminance among the red subpixel, green subpixel and white subpixel, is $R_sY$, $G_sY$, $W_sY$, and $R_sY+G_sY+W_sY=1$;

performing calibration process to the first data by applying the normalized proportion $R_sY$, $G_sY$, $W_sY$ to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k)$$

$$B_{fo}(k)=B_o(k)'$$

$$W_{fo}(k)=W_o(k)*W_sY(k),$$

wherein, $R_o(k)$, $G_o(k)$, $B_o(k)$, $W_o(k)$ is a first data of a pixel point k, $R_{fo}(k)$, $G_{fo}(k)$, $B_{fo}(k)$, $W_{fo}(k)$ is a second data of the pixel point k, $R_sY(k)$, $G_sY(k)$, $W_sY(k)$ is a normalized proportion of a luminance among a red subpixel, green subpixel and white subpixel of the pixel point k.

Wherein, the normalized proportion $B_sY$, $G_sY$, $W_sY$ is obtained according to a formula 1 and the formula 1 is:

$$W_sY = \frac{\begin{array}{l} B_sx*G_sy*W_sy - B_sy*G_sx*W_sy - B_sx*W_sy*W_dy + \\ B_sy*W_sy*W_dx + G_sx*W_sy*W_dy - G_sy*W_sy*W_dx \end{array}}{\begin{array}{l} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}}$$

$$G_sY = \frac{\begin{array}{l} B_sx*G_sy*W_sy - B_sy*G_sy*W_sx - B_sx*G_sy*W_dy + \\ B_sy*G_sy*W_dx + G_sy*W_sx*W_dy - G_sy*W_sy*W_dx \end{array}}{\begin{array}{l} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}}$$

$$B_sY = \frac{\begin{array}{l} B_sy*G_sx*W_sy - B_sy*G_sy*W_sx - B_sy*G_sx*W_dy + \\ B_sy*G_sy*W_dx + B_sy*W_sx*W_dy - B_sy*W_sy*W_dx \end{array}}{\begin{array}{l} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Wherein, the normalized proportion $B_sY$, $R_sY$, $W_sY$ is obtained according to a formula 2, and the formula 2 is:

$$W_sY = \frac{\begin{array}{l} B_sx*R_sy*W_sy - B_sy*R_sx*W_sy - B_sx*W_sy*W_dy + \\ B_sy*W_sy*W_dx + R_sx*W_sy*W_dy - R_sy*W_sy*W_dx \end{array}}{\begin{array}{l} B_sx*R_sy*W_dy - B_sy*R_sx*W_dy - B_sx*W_sy*W_dy + \\ B_sy*W_sx*W_dy + G_sx*W_sy*W_dy - R_sy*W_sx*W_dy \end{array}}$$

$$R_sY = \frac{\begin{array}{l} B_sx*R_sy*W_sy - B_sy*R_sy*W_sx - B_sx*R_sy*W_dy + \\ B_sy*R_sy*W_dx + R_sy*W_sx*W_dy - R_sy*W_sy*W_dx \end{array}}{\begin{array}{l} B_sx*R_sy*W_dy - B_sy*R_sx*W_dy - B_sx*W_sy*W_dy + \\ B_sy*W_sx*W_dy + R_sx*W_sy*W_dy - R_sy*W_sx*W_dy \end{array}}$$

$$B_sY = \frac{\begin{array}{l} B_sy*R_sx*W_sy - B_sy*R_sy*W_sx - B_sy*R_sx*W_dy + \\ B_sy*R_sy*W_dx + B_sy*W_sx*W_dy - B_sy*W_sy*W_dx \end{array}}{\begin{array}{l} B_sx*R_sy*W_dy - B_sy*R_sx*W_dy - B_sx*W_sy*W_dy + \\ B_sy*W_sx*W_dy + R_sx*W_sy*W_dy - R_sy*W_sx*W_dy \end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Wherein, the normalized proportion $R_sY$, $G_sY$, $W_sY$ is obtained according to a formula 3, and the formula 3 is:

$$W_sY = \frac{\begin{array}{l} R_sx*G_sy*W_sy - R_sy*G_sx*W_sy - R_sx*W_sy*W_dy + \\ R_sy*W_sy*W_dx + G_sx*W_sy*W_dy - G_sy*W_sy*W_dx \end{array}}{\begin{array}{l} R_sx*G_sy*W_dy - R_sy*G_sx*W_dy - R_sx*W_sy*W_dy + \\ R_sy*W_sx*W_dy + G_sx*W_sy*W_dy - G_sy*W_sx*W_dy \end{array}}$$

$$G_sY = \frac{\begin{array}{l} R_sx*G_sy*W_sy - R_sy*G_sy*W_sx - R_sx*G_sy*W_dy + \\ R_sy*G_sy*W_dx + G_sy*W_sx*W_dy - G_sy*W_sy*W_dx \end{array}}{\begin{array}{l} R_sx*G_sy*W_dy - R_sy*G_sx*W_dy - R_sx*W_sy*W_dy + \\ R_sy*W_sx*W_dy + G_sx*W_sy*W_dy - G_sy*W_sx*W_dy \end{array}}$$

-continued $$R_sY = \frac{\begin{array}{l} R_sy*G_sx*W_sy - R_sy*G_sy*W_sx - R_sy*G_sx*W_dy + \\ R_sy*G_sy*W_dx + R_sy*W_sx*W_dy - R_sy*W_sy*W_dx \end{array}}{\begin{array}{l} R_sx*G_sy*W_dy - R_sy*G_sx*W_dy - R_sx*W_sy*W_dy + \\ R_sy*W_sx*W_dy + G_sx*W_sy*W_dy - G_sy*W_sx*W_dy \end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

To solve the aforementioned technical problem, another technical solution applied in the present invention is: providing a method of RGBW compensation based on color aberrations of white subpixel, wherein, aberrations exist between a color coordinate point $W_s$ of white subpixel of image pixels on a RGBW panel and a standard white color coordinate point $W_d$ under sRGB before compensating, and the method comprises: inserting the image pixels based on a first data of RGBW color space; analyzing color coordinates of every subpixel of the image pixels on the RGBW panel, and then dividing a triangle $R_sG_sB_s$ with vertices color coordinate points $R_s$, $G_s$, and $B_s$ of red subpixel, green subpixel and green pixel of the image points into three triangle regions, $R_sG_sW_s$, $R_sB_sW_s$, $B_sG_sW_s$, based on taking the color coordinate point $W_s$ as the center point; confirming a triangle region where the color coordinate point is located based on ranges of the three triangle regions, $R_sG_sW_s$, $R_sB_sW_s$, $B_sG_sW_s$; performing compensating the white subpixel corresponding by the center point $W_s$ via a predetermined normalized proportion to calibrated the first data through two subpixels corresponding to the other two color coordinate points, except the center point $W_s$, within the triangle region surrounding and locating the color coordinate point $W_d$; exporting the post-compensated a second data of image pixels based on the RGBW color space.

Wherein, steps of performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$ comprises: if the color coordinate point $W_d$ is located within the triangle region $B_sG_sW_s$, a normalized proportion calculating a luminance among subpixel, the blue subpixel, green subpixel and white subpixel, is $B_sY$, $G_sY$, $W_sY$, and $B_sY+G_sY+W_sY=1$; performing calibration process to the first data by applying the normalized proportion $B_sY$, $G_sY$, $W_sY$ to obtain a second data of image pixels based on the RGBW color space, $$R_{fo}(i)=R_o(i)$$

$$G_{fo}(i)=G_o(i)+W_o(i)*G_sY(i)$$

$$B_{fo}(i)=B_o(i)+W_o(i)*B_sY(i)'$$

$$W_{fo}(i)=W_o(i)*W_sY(i),$$

wherein, $R_o(i)$, $G_o(i)$, $B_o(i)$, $W_o(i)$ is a first data of a pixel point i, $R_{fo}(i)$, $G_{fo}(i)$, $B_{fo}(i)$, $W_{fo}(i)$ is a second data of the pixel point i, $B_sY(i)$, $G_sW_sY(i)$ is a normalized proportion of a luminance among a blue subpixel, green subpixel and white subpixel of the pixel point i.

Wherein, the normalized proportion $B_sY$, $G_sY$, $W_sY$ is obtained according to a formula 1, and the formula 1 is:

$$W_sY = \frac{B_sx*G_sy*W_sy - B_sy*G_sx*W_sy - B_sx*W_sy*W_dy + B_sy*W_sy*W_dx + G_sx*W_sy*W_dy - G_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

$$G_sY = \frac{B_sx*G_sy*W_sy - B_sy*G_sy*W_sx - B_sx*G_sy*W_dy + B_sy*G_sy*W_dx + G_sy*W_sx*W_dy - G_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

$$B_sY = \frac{B_sy*G_sx*W_sy - B_sy*G_sy*W_sx - B_sy*G_sx*W_dy + B_sy*G_sy*W_dx + B_sy*W_sx*W_dy - B_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Wherein, steps for performing compensating the white subpixel corresponding by the center point $W_s$ via a predetermined normalized proportion to calibrated the first data through the two subpixels corresponding to the other two color coordinate points, except the center point $W_s$, within the triangle region surrounding and locating the color coordinate point $W_d$ comprises: if the color coordinate point $W_d$ is located within the triangle region $B_sR_sW_s$, a normalized proportion calculating a luminance among the blue subpixel, red subpixel and white subpixel, is $B_sY$, $R_sY$, $W_sY$, and $B_sY+R_sY+W_sY=1$; performing calibration process to the first data by applying the normalized proportion $B_sY$, $R_sY$, $W_sY$ to obtain a second data of image pixels based on the RGBW color space, $$R_{fo}(j)=R_o(j)+W_o(j)*R_sY(j)$$

$$G_{fo}(j)=G_o(j)$$

$$B_{fo}(j)=B_o(j)+W_o(j)*B_sY(j)'$$

$$W_{fo}(j)=W_o(j)*W_sY(j),$$

wherein, $R_o(j)$, $G_o(j)$, $B_o(j)$, $W_o(j)$ is a first data of a pixel point j, $R_{fo}(j)$, $G_{fo}(j)$, $B_{fo}(j)$, $W_{fo}(j)$ is a second data of the pixel point j, $B_sY(j)$, $R_sY(j)$, $W_sY(j)$ is a normalized proportion of a luminance among a blue subpixel, red subpixel and white subpixel of the pixel point j.

Wherein, the normalized proportion $B_sY$, $R_sY$, $W_sY$ is obtained according to a formula 2, and the formula 2 is:

$$W_sY = \frac{B_sx*R_sy*W_sy - B_sy*R_sx*W_sy - B_sx*W_sy*W_dy + B_sy*W_sy*W_dx + R_sx*W_sy*W_dy - R_sy*W_sy*W_dx}{B_sx*R_sy*W_dy - B_sy*R_sx*W_dy - B_sx*W_sy*W_dy + B_sy*W_sx*W_dy + G_sx*W_sy*W_dy - R_sy*W_sx*W_dy}$$

$$R_sY = \frac{B_sx*R_sy*W_sy - B_sy*R_sy*W_sx - B_sx*R_sy*W_dy + B_sy*R_sy*W_dx + R_sy*W_sx*W_dy - R_sy*W_sy*W_dx}{B_sx*R_sy*W_dy - B_sy*R_sx*W_dy - B_sx*W_sy*W_dy + B_sy*W_sx*W_dy + R_sx*W_sy*W_dy - R_sy*W_sx*W_dy}$$

-continued $$B_sY = \frac{B_sy*R_sx*W_sy - B_sy*R_sy*W_sx - B_sy*R_sx*W_dy + B_sy*R_sy*W_dx + B_sy*W_sx*W_dy - B_sy*W_sy*W_dx}{B_sx*R_sy*W_dy - B_sy*R_sx*W_dy - B_sx*W_sy*W_dy + B_sy*W_sx*W_dy + R_sx*W_sy*W_dy - R_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Wherein, steps of performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$ comprises: if the color coordinate point $W_d$ is located within the triangle region $R_sG_sW_s$, a normalized proportion calculating a luminance among the red subpixel, green subpixel and white subpixel, is $R_sY$, $G_sY$, $W_sY$, and $R_sY+G_sY+W_sY=1$; performing calibration process to the first data by applying the normalized proportion $R_sY$, $G_sY$, $W_sY$ to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k)$$

$$B_{fo}(k)=B_o(k)'$$

$$W_{fo}(k)=W_o(k)*W_sY(k),$$

wherein, $R_o(k)$, $G_o(k)$, $B_o(k)$, $W_o(k)$ is a first data of a pixel point k, $R_{fo}(k)$, $G_{fo}(k)$, $B_{fo}(k)$, $W_{fo}(k)$ is a second data of the pixel point k, $R_sY(k)$, $G_sY(k)$, $W_sY(k)$ is a normalized proportion of a luminance among a red subpixel, green subpixel and white subpixel of the pixel point k.

Wherein, wherein, the normalized proportion $R_sY$, $G_sY$, $W_sY$ is obtained according to a formula 3, and the formula 3 is:

$$W_sY = \frac{R_sx*G_sy*W_sy - R_sy*G_sx*W_sy - R_sx*W_sy*W_dy + R_sy*W_sy*W_dx + G_sx*W_sy*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$G_sY = \frac{R_sx*G_sy*W_sy - R_sy*G_sy*W_sx - R_sx*G_sy*W_dy + R_sy*G_sy*W_dx + G_sy*W_sx*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$R_sY = \frac{R_sy*G_sx*W_sy - R_sy*G_sy*W_sx - R_sy*G_sx*W_dy + R_sy*G_sy*W_dx + R_sy*W_sx*W_dy - R_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

To solve the aforementioned technical problem, another technical solution applied in the present invention is: an apparatus of RGBW compensation is provided based on color aberrations of white subpixel, aberrations exist between a color coordinate point $W_s$ of white subpixel of image pixels on a RGBW panel and a standard white color coordinate point $W_d$ under sRGB before compensating, and the apparatus comprises: an inserting module, used in inserting the image pixels based on a first data of RGBW color space; a dividing module, used in analyzing color coordinates of every subpixel of the image pixels on the RGBW panel, and then dividing a triangle $R_sG_sB_s$ with vertices color coordinate points $R_s$, $G_s$, and $B_s$ of red subpixel, green subpixel and green pixel of the image points into three triangle regions, $R_sG_sW_s$, $R_sB_sW_s$, $B_sG_sW_s$, based on taking the color coordinate point $W_s$ as the center point; a confirming module, used in confirming a triangle region where the color coordinate point is located based on ranges of the three triangle regions, $R_sG_sW_s$, $R_sB_sW_s$, $B_sG_sW_s$; a compensating module, used in performing compensating the white subpixel corresponding by the center point $W_s$ via a predetermined normalized proportion to calibrated the first data through two subpixels corresponding to the other two color coordinate points, except the center point $W_s$, within the triangle region surrounding and locating the color coordinate point $W_d$; an exporting module, used in exporting the post-compensated a second data of image pixels based on the RGBW color space.

Wherein, the compensating module comprises: a first calculating unit, used in while the color coordinate point $W_d$ is located within the triangle region $B_sG_sW_s$, a normalized proportion calculating a luminance among subpixel, the blue subpixel, green subpixel and white subpixel, is $B_sY$, $G_sY$, $W_sY$, and $B_sY+G_sY+W_sY=1$; a first calibration unit, used in performing the calibration process to the first data by applying the normalized proportion $B_sY_s$, $G_sY$, $W_sY$ to obtain a second data of image pixels based on the RGBW color space, $$R_{fo}(i)=R_o(i)$$

$$G_{fo}(i)=G_o(i)+W_o(i)*G_sY(i)$$

$$B_{fo}(i)=B_o(i)+W_o(i)*B_sY(i)'$$

$$W_{fo}(i)=W_o(i)*W_sY(i),$$

wherein, $R_o(i)$, $G_o(i)$, $B_o(i)$, $W_o(i)$ is a first data of a pixel point i, $R_{fo}(i)$, $G_{fo}(i)$, $B_{fo}(i)$, $W_{fo}(i)$ is a second data of the pixel point i, $B_sY(i)$, $G_sY(i)$, $W_sY(i)$ is a normalized proportion of a luminance among a blue subpixel, green subpixel and white subpixel of the pixel point i.

Wherein, the normalized proportion $B_sY$, $G_sY$, $W_sY$ is obtained according to a formula 1, and the formula 1 is:

$$W_sY=\frac{B_sx*G_sy*W_sy-B_sy*G_sx*W_sy-B_sx*W_sy*W_dy+B_sy*W_sy*W_dx+G_sx*W_sy*W_dy-G_sy*W_sy*W_dx}{B_sx*G_sy*W_dy-B_sy*G_sx*W_dy-B_sx*W_sy*W_dy+B_sy*W_sx*W_dy+G_sx*W_sy*W_dy-G_sy*W_sx*W_dy}$$

$$G_sY=\frac{B_sx*G_sy*W_sy-B_sy*G_sy*W_sx-B_sx*G_sy*W_dy+B_sy*G_sy*W_dx+G_sy*W_sx*W_dy-G_sy*W_sy*W_dx}{B_sx*G_sy*W_dy-B_sy*G_sx*W_dy-B_sx*W_sy*W_dy+B_sy*W_sx*W_dy+G_sx*W_sy*W_dy-G_sy*W_sx*W_dy}$$

-continued $$B_sY=\frac{B_sy*G_sx*W_sy-B_sy*G_sy*W_sx-B_sy*G_sx*W_dy+B_sy*G_sy*W_dx+B_sy*W_sx*W_dy-B_sy*W_sy*W_dx}{B_sx*G_sy*W_dy-B_sy*G_sx*W_dy-B_sx*W_sy*W_dy+B_sy*W_sx*W_dy+G_sx*W_sy*W_dy-G_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Wherein, the compensating module comprises: a second calculating unit, used in while the color coordinate point $W_d$ is located within the triangle region $B_sR_sW_s$, a normalized proportion calculating a luminance among the blue subpixel, red subpixel and white subpixel, is $B_sY$, $R_sY$, $W_sY$, and $B_sY+R_sY+W_sY=1$; a second calibration unit, used in performing calibration process to the first data by applying the normalized proportion $B_sY$, $R_sY$, $W_sY$ to obtain a second data of image pixels based on the RGBW color space, $$R_{fo}(j)=R_o(j)+W_o(j)*R_sY(j)$$

$$G_{fo}(j)=G_o(j)$$

$$B_{fo}(j)=B_o(j)+W_o(j)*B_sY(j)'$$

$$W_{fo}(j)=W_o(j)*W_sY(j)$$

wherein, $R_o(j)$, $G_o(j)$, $B_o(j)$, $W_o(j)$ is a first data of a pixel point j, $R_{fo}(j)$, $G_{fo}(j)$, $B_{fo}(j)$, $W_{fo}(j)$ is a second data of the pixel point j, $B_sY(j)$, $R_sY(j)$, $W_sY(j)$ i s a normalized proportion of a luminance among a blue subpixel, red subpixel and white subpixel of the pixel point j.

Wherein, the normalized proportion $B_sY$, $R_sY$, $W_sY$ is obtained according to a formula 2, and the formula 2 is:

$$W_sY=\frac{B_sx*R_sy*W_sy-B_sy*R_sx*W_sy-B_sx*W_sy*W_dy+B_sy*W_sy*W_dx+R_sx*W_sy*W_dy-R_sy*W_sy*W_dx}{B_sx*R_sy*W_dy-B_sy*R_sx*W_dy-B_sx*W_sy*W_dy+B_sy*W_sx*W_dy+G_sx*W_sy*W_dy-R_sy*W_sx*W_dy}$$

$$R_sY=\frac{B_sx*R_sy*W_sy-B_sy*R_sy*W_sx-B_sx*R_sy*W_dy+B_sy*R_sy*W_dx+R_sy*W_sx*W_dy-R_sy*W_sy*W_dx}{B_sx*R_sy*W_dy-B_sy*R_sx*W_dy-B_sx*W_sy*W_dy+B_sy*W_sx*W_dy+R_sx*W_sy*W_dy-R_sy*W_sx*W_dy}$$

$$B_sY=\frac{B_sy*R_sx*W_sy-B_sy*R_sy*W_sx-B_sy*R_sx*W_dy+B_sy*R_sy*W_dx+B_sy*W_sx*W_dy-B_sy*W_sy*W_dx}{B_sx*R_sy*W_dy-B_sy*R_sx*W_dy-B_sx*W_sy*W_dy+B_sy*W_sx*W_dy+R_sx*W_sy*W_dy-R_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Wherein, the compensating module comprises: a third calculating unit, used in while the color coordinate point $W_d$ is located within the triangle region $R_sG_sW_s$, a normalized proportion calculating a luminance among the red subpixel, green subpixel and white subpixel, is $R_sY$, $G_sY$, $W_sY$, and $R_sY+G_sY+W_sY=1$; a third calibration unit, used in performing calibration process to the first data by applying the normalized proportion $R_sY$, $G_sY$, $W_sY$ to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k)$$

$$B_{fo}(k)=B_o(k)'$$

$$W_{fo}(k)=W_o(k)*W_sY(k),$$

wherein, $R_o(k)$, $G_o(k)$, $B_o(k)$, $W_o(k)$ is a first data of a pixel point k, $R_{fo}(k)$, $G_{fo}(k)$, $B_{fo}(k)$, $W_{fo}(k)$ is a second data of the pixel point k, $R_sY(k)$, $G_sY(k)$, $W_sY(k)$ is a normalized proportion of a luminance among a red subpixel, green subpixel and white subpixel of the pixel point k.

Wherein, the normalized proportion $R_sY$, $G_sY$, $W_sY$ is obtained according to a formula 3, and the formula 3 is:

$$W_sY=\frac{R_sx*G_sy*W_sy-R_sy*G_sx*W_sy-R_sx*W_sy*W_dy+R_sy*W_sy*W_dx+G_sx*W_sy*W_dy-G_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy}$$

$$G_sY=\frac{R_sx*G_sy*W_sy-R_sy*G_sy*W_sx-R_sx*G_sy*W_dy+R_sy*G_sy*W_dx+G_sy*W_sx*W_dy-G_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy}$$

$$R_sY=\frac{R_sy*G_sx*W_sy-R_sy*G_sy*W_sx-R_sy*G_sx*W_dy+R_sy*G_sy*W_dx+R_sy*W_sx*W_dy-R_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

The present invention can be concluded with the following advantages: as compared to the existing prior art, when aberrations exist between a color coordinate point $W_s$ of white subpixel of image pixels and a standard white color coordinate point $W_d$ under sRGB, analyzing color coordinates of every subpixel of the image pixels on the RGBW panel, and then dividing a triangle $R_sG_sB_s$ with vertices color coordinate points $R_s$, $G_s$, and $B_s$ of red subpixel, green subpixel and green pixel of the image points into three triangle regions based on taking the color coordinate point $W_s$ as the center point; based on ranges of the three triangle regions, $R_sG_sW_s$, $R_sB_sW_s$, $B_sG_sW_s$, a triangle region where the color coordinate point is located is confirmed; the first data is calibrated by performing compensating the white subpixel corresponding by the center point s via a predetermined normalized proportion through two subpixels corresponding to the other two color coordinate points, except the center point $W_s$, within the triangle region surrounding and locating the color coordinate point $W_d$. Because the first data can be calibrated by performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$; therefore, the situation of aberrations of white subpixels can be calibrated specifically and further images of GRBW panels can be normalized.

DETAILED DESCRIPTION OF THE PREFERRED EMBODIMENTS

Figure 1:
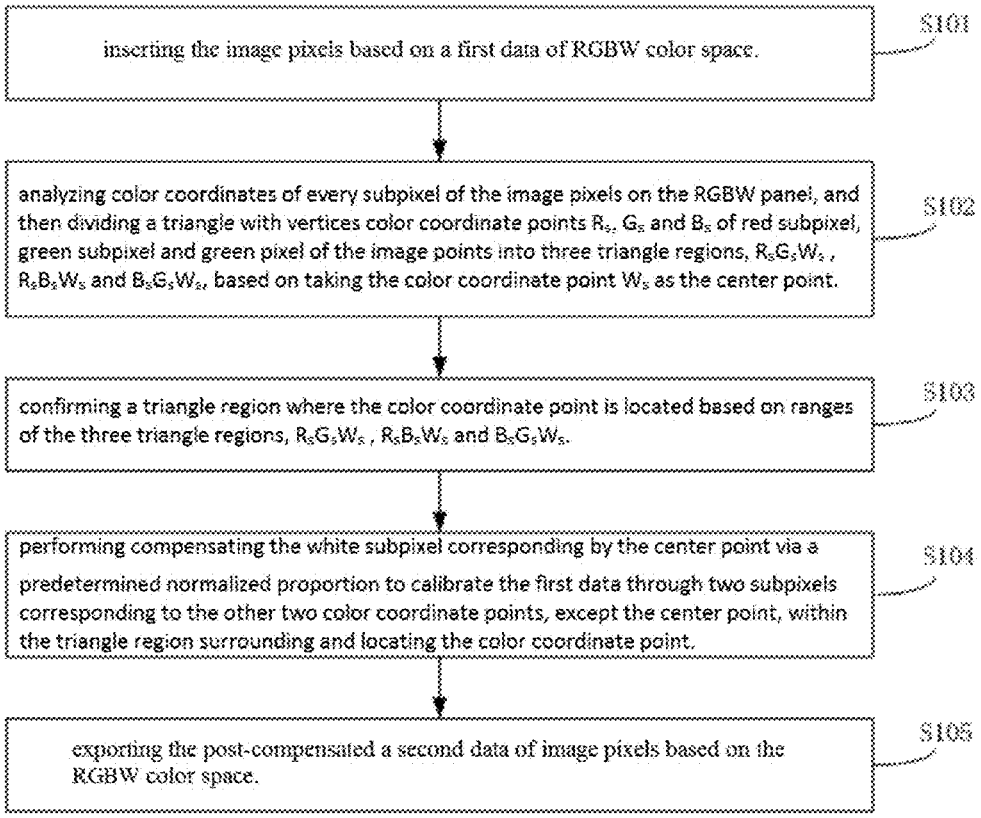
FIG. 1 is a flowchart of an embodiment representing a method of RGBW compensation based on color aberrations of white subpixel in the present invention.

Detailed descriptions will be given along with the embodiment illustrated in the attached drawings. FIG. 1 is a flowchart of an embodiment representing a method of RGBW compensation based on color aberrations of white subpixel in the present invention.

Refer to FIG. 1, FIG. 1 is a flowchart of an embodiment representing a method of RGBW compensation based on color aberrations of white subpixel in the present invention. Before performing compensating via method adopted in the present invention, aberrations exist between a color coordinate point $W_s$ of white subpixel of image pixels on a RGBW panel and a standard white color coordinate point $W_d$ under sRGB, and the method comprises:

step S101: inserting the image pixels based on a first data of RGBW color space.

step S102: analyzing color coordinates of every subpixel of the image pixels on the RGBW panel, and then dividing a triangle $R_sG_sB_s$ with vertices color coordinate points $R_s$, $G_s$, and $B_s$ of red subpixel, green subpixel and green pixel of the image points into three triangle regions, $R_sG_sW_s$, $R_sB_sW_s$, $B_sG_sW_s$, based on taking the color coordinate point $W_s$ as the center point.

Figure 2:
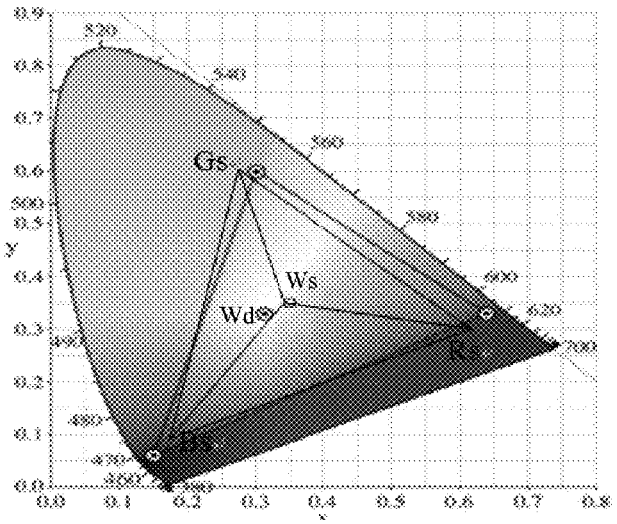
FIG. 2 is schematic diagram showing positions of four subpixels with reference to chromaticity diagram in an embodiment.

Respective subpixel of image pixels on RGBW panels can be represented by a particular coordinate point with reference to chromaticity diagram, and the particular coordinate point herein has a particular color coordinate value (x,y). There are four kinds of subpixels in the image pixels on RGBW panels, and those are red subpixels, green subpixels, blue subpixels and white subpixels respectively. Refer to FIG. 2, these four subpixels are corresponding to the color coordinate points, $R_s$, $G_s$, $B_s$ and $W_s$, positioned in the surrounding triangle $R_sG_sB_s$, and the triangle $R_sG_sB_s$ is divided into three triangles regions, $R_sG_sW_s$, $R_sB_sW_s$, $B_sG_sW_s$, based on taking the color coordinate point $W_s$ as the center point.

Step 103: confirming a triangle region where the color coordinate point is located based on ranges of the three triangle regions, $R_sG_sW_s$, $R_sB_sW_s$, $B_sG_sW_s$.

Right after ranges of the three triangle regions, $R_sG_sW_s$, $R_sB_sW_s$, $B_sG_sW_s$, are confirmed, the color coordinate point $W_d$ located within a triangle region can be confirmed as well, as shown in FIG. 2. In a particular example, a coordinate value of the standard white color coordinate point $W_d$ under sRGB is (0.3127,0.329) (as shown in white circle of the triangle $R_sG_sB_s$), and a coordinate value of the color coordinate point $W_s$ of the image pixels is (0.34,0.35) (as shown in the white block in the triangle $R_sG_sB_s$); the triangle region where $W_d$ locating is $B_sG_sW_s$.

Step 104: performing compensating the white subpixel corresponding by the center point $W_s$ via a predetermined normalized proportion to calibrate the first data through two subpixels corresponding to the other two color coordinate points, except the center point $W_s$, within the triangle region surrounding and locating the color coordinate point $W_d$.

$W_d$ is a standard white color coordinate point, and $W_d$ is located at a particular triangle region, and when aberrations existing between $W_s$ and $W_d$, means calibration needed for $W_s$; when calibration is performing, the rest subpixels exhibit largest influence upon the white subpixels within the triangle region; therefore, the calibration is performed by adopting two subpixels corresponding to the other two color coordinate points, except $W_s$, within the triangle region surrounding and locating the color coordinate point $W_d$, and when the calibration is performed, influences of the two subpixels is confirmed by a predetermined normalized proportion.

The predetermined normalized proportion not only can be confirmed by performing calculations of coordinate values and standard optical calculating formulas, but can also be confirmed by experimental data.

Step 105: exporting the post-compensated a second data of image pixels based on the RGBW color space.

In embodiments of the present invention, when aberrations exist between a color coordinate point $W_s$ of white pixels of image pixels and a standard white color coordinate point $W_d$ under sRGB, color coordinates of every subpixel of the image pixels on the RGBW panel are analyzed, and then a triangle $R_sG_sB_s$ with vertices color coordinate points $R_s$, $G_s$, and $B_s$ of red subpixel, green subpixel and green pixel of the image points is divided into three triangle regions, $R_sG_sW_s$, $R_sB_sW_s$, $B_sG_sW_s$, based on taking the color coordinate point $W_s$ as the center point; based on ranges of the three triangle regions, $R_sG_sW_s$, $R_sB_sW_s$, $B_sG_sW_s$, a triangle region where the color coordinate point is located is confirmed; the first data is calibrated by performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$. Because the first data can be calibrated by performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$; therefore, the situation of aberrations of white subpixels can be calibrated specifically and further images of GRBW panels can be normalized.

Figure 3:
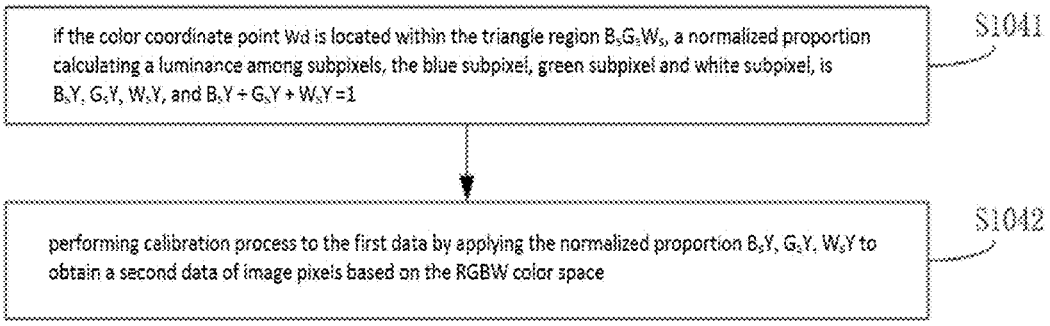
FIG. 3 is a flowchart of another embodiment representing a method of RGBW compensation based on color aberrations of white subpixel in the present invention.

Wherein, as shown in FIG. 3, step S104 can particularly include: substep S1041 and substep S1042.

Substep S1041: if the color coordinate point $W_d$ is located within the triangle region $B_sG_sW_s$, a normalized proportion calculating a luminance among subpixels, the blue subpixel, green subpixel and white subpixel, is $B_sY$, $G_sY$, $W_sY$, and $B_sY+G_sY+W_sY=1$.

Substep S1042: performing calibration process to the first data by applying the normalized proportion $B_sY$, $G_sY$, $W_sY$ to obtain a second data of image pixels based on the RGBW color space, $$R_{fo}(i)=R_o(i)$$

$$G_{fo}(i)=G_o(i)+W_o(i)*G_sY(i)$$

$$B_{fo}(i)=B(i)+W_o(i)*B_sY(i)'$$

$$W_{fo}(i)=W_o(i)*W_sY(i),$$

wherein, $R_o(i)$, $G_o(i)$, $B_o(i)$, $W_o(i)$ is a first data of a pixel point i, $R_{fo}(i)$, $G_{fo}(i)$, $B_{fo}(i)$, $W_{fo}(i)$ is a second data of the pixel point i, $B_sY(i)$, $G_sY(i)$, $W_sY(i)$ is a normalized proportion of a luminance among a blue subpixel, green subpixel and white subpixel of the pixel point i.

If the color coordinate point $W_d$ is located within the triangle region $B_sR_sW_s$, that means when calibrating, performing calibration of white subpixels can adopt blue subpixels and green subpixels to do so. In particular, a normalized proportion calculating a luminance among the blue subpixel, red subpixel and white subpixels $B_sY$, $R_sY$, $W_sY$, wherein $B_sY+R_sY+W_sY=1$. Right after normalized proportion $B_sY$, $R_sY$, $W_sY$ is confirmed, the first data can be performed in calibrating to get the second data of image pixels according to RGBW color space.

Wherein, the first data is data based on RGBW color space, and before the first data is obtained, the original data $R_i$, $G_i$, $B_i$ based on RGB color space is transferred into a first data $R_o$, $G_o$, $B_o$, $W_o$ based on RGBW color space by traditional RGBW transferred calculation or other calculations different from RGBW transferred calculation. Next, after implementing the method of the present invention, calibrations are performed to situations of aberrations of white subpixels to normalize images of the RGBW panels.

Figure 4:
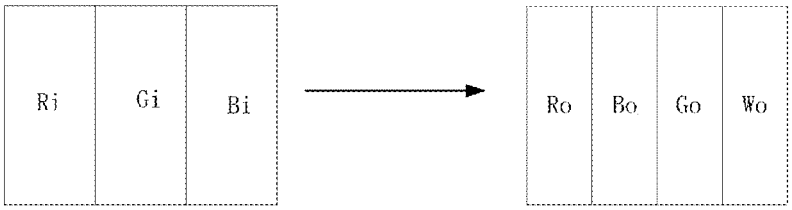
FIG. 4 is a schematic diagram of a first data based on RGB color space transferred from original data based on RGBW color space.

For example, as shown in FIG. 4, after transferring the original data $R_i$, $G_i$, $B_i$, based on RGB color space into the first data $R_o$, $G_o$, $B_o$, $W_o$ based on RGBW color space to obtain $$R_o = R_i - W_o$$

$$G_o = G_i - W_o$$

$$B_o = B_i - W_o$$

$$W_o = \min[R_i, G_i, B_i].$$

Next, after implementing the method of the present invention, the calibration performed to situations of aberrations of white subpixels to normalize images of the RGBW panels. 例如

$$R_o = R_i - W_o$$

$$G_o = G_i - W_o$$

$$B_o = B_i - W_o$$

$$W_o = \min[R_i, G_i, B_i].$$

Wherein, the normalized proportion $B_sY$, $G_sY$, $W_sY$ is obtained according to a formula 1, and the formula 1 is:

$$W_sY = \frac{\begin{array}{c} B_sx*G_sy*W_sy - B_sy*G_sx*W_sy - B_sx*W_sy*W_dy + \\ B_sy*W_sy*W_dx + G_sx*W_sy*W_dy - G_sy*W_sy*W_dx \end{array}}{\begin{array}{c} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}}$$

$$G_sY = \frac{\begin{array}{c} B_sx*G_sy*W_sy - B_sy*G_sy*W_sx - B_sx*G_sy*W_dy + \\ B_sy*G_sy*W_dx + G_sy*W_sx*W_dy - G_sy*W_sy*W_dx \end{array}}{\begin{array}{c} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}}$$

$$BsY = \frac{\begin{array}{c} B_sy*G_sx*W_sy - B_sy*G_sy*W_sx - B_sy*G_sx*W_dy + \\ B_sy*G_sy*W_dx + B_sy*W_sx*W_dy - B_sy*W_sy*W_dx \end{array}}{\begin{array}{c} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

The derivation of the aforementioned formula 1 is as following: X, Y and Z are three stimulus values, wherein, Y represents luminance; x and y are color coordinate values; Fixed conjunctive formulas are existing between (X, Y, Z) and (x, y):

$$x=X/(X+Y+Z)$$

$$y=Y/(X+Y+Z)$$

According to the aforementioned conjunctive formulas, the next formula can be obtained:

$$W_sX/(W_sX+W_sY+W_sZ)=W_sx \quad (1)$$

$$W_sY/(W_sX+W_sY+W_sZ)=W_sy \quad (2)$$

$$G_sX/(G_sX+G_sY+G_sZ)=G_sx \quad (3)$$

$$G_sY/(G_sX+G_sY+G_sZ)=G_sy \quad (4)$$

$$B_sX/(B_sX+B_sY+B_sZ)=B_sx \quad (5)$$

$$B_sY/(B_sX+B_sY+B_sZ)=B_sy \quad (6)$$

$$W_sY+G_sY+B_sY=1 \quad (7)$$

$$(W_sX+G_sX+B_sX)/(W_sX+G_sX+B_sX+W_sY+G_sY+B_sY+W_sZ+G_sZ+B_sZ)=W_dx \quad (8)$$

$$(W_sY+G_sY+B_sY)/(W_sX+G_sX+B_sX+W_sY+G_sY+B_sY+W_sZ+G_sZ+B_sZ)=W_dy \quad (9)$$

In the aforementioned 9 formulas, $W_sX$, $W_sY$ and $W_sZ$ are three respective stimulus values of a white pixel of a particular pixel and are unknowns to find a solution; $G_sX$, $G_sY$ and $G_sZ$ are three respective stimulus values of a green pixel of a particular pixel and are unknowns to find a solution; $B_sX$, $B_sY$ and $B_sZ$ are three respective stimulus values of a blue pixel of a particular pixel and are unknowns to find a solution. $(B_sx, B_sy)$ is a coordinate value of the blue subpixel of the image pixel on RGBW panel, and is a known value on RGBW panel; $(G_sx, G_sy)$ is a coordinate value of the green subpixel of the image pixel on RGBW panel, and is a known value on RGBW panel; $(W_sx, W_sy)$ is a coordinate value of the white subpixel of the image pixel on RGBW panel, and is a known value on RGBW panel; $(W_dx, W_dy)$ is a standard white coordinate under sRGB, and is a known value.

In the aforementioned 9 formulas, after solving 9 unknowns, luminance signal thereof can be solved then: $W_sY$, $G_sY$ and $B_sY$ is also a normalized proportion.

Figure 5:
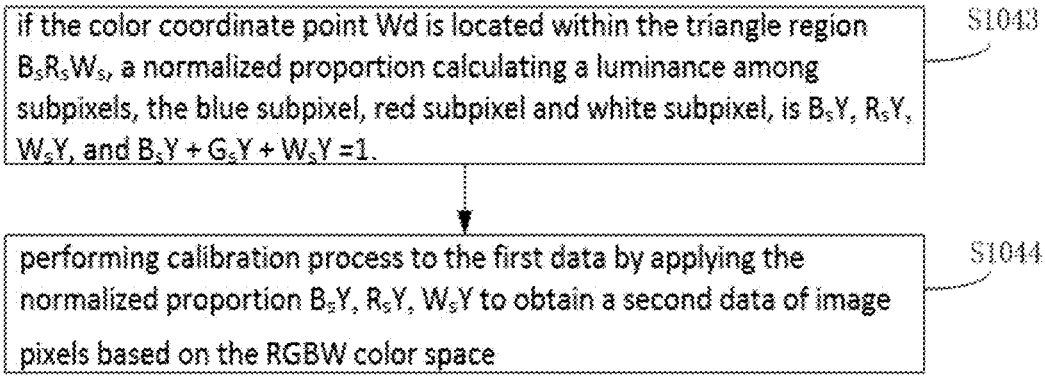
FIG. 5 is a flowchart of still another embodiment representing a method of RGBW compensation based on color aberrations of white subpixel in the present invention.

Wherein, as shown in FIG. 5, step S104 can particularly include: substep S1043 and sub step S1044.

Substep S1043: if the color coordinate point $W_d$ is located within the triangle region $B_sR_sW_s$, a normalized proportion calculating a luminance among subpixels, the blue subpixel, red subpixel and white subpixel, is $B_sY$, $R_sY$, $W_sY$, and $B_sY+R_sY+W_sY=1$.

Substep S1044: performing calibration process to the first data by applying the normalized proportion $B_sY$, $R_sY$, $W_sY$ to obtain a second data of image pixels based on the RGBW color space, $$R_{fo}(j)=R_o(j)+W_o(j)*R_sY(j)$$

$$G_{fo}(j)=G_o(j)$$

$$B_{fo}(j)=B_o(j)+W_o(j)*B_sY(j)$$

$$W_{fo}(j)=W_o(j)*W_sY(j),$$

wherein, $R_o(j)$, $G_o(j)$, $B_o(j)$, $W_o(j)$ is a first data of a pixel point j, $R_{fo}(j)$, $G_{fo}(j)$, $B_{fo}(j)$, $W_{fo}(j)$ is a second data of the pixel point j, $B_sY(j)$, $R_sY(j)$, $W_sY(j)$ is a normalized proportion of a luminance among a blue subpixel, green subpixel and white subpixel of the pixel point j.

Wherein, the normalized proportion $B_sY$, $R_sY$, $W_sY$ is obtained according to a formula 2, and the formula 2 is:

$$W_sY = \frac{\begin{array}{c} B_sx*R_sy*W_sy - B_sy*R_sx*W_sy - B_sx*W_sy*W_dy + \\ B_sy*W_sy*W_dx + R_sx*W_sy*W_dy - R_sy*W_sy*W_dx \end{array}}{\begin{array}{c} B_sx*R_sy*W_dy - B_sy*R_sx*W_dy - B_sx*W_sy*W_dy + \\ B_sy*W_sx*W_dy + G_sx*W_sy*W_dy - R_sy*W_sx*W_dy \end{array}}$$

$$R_sY = \frac{\begin{array}{c} B_sx*R_sy*W_sy - B_sy*R_sy*W_sx - B_sx*R_sy*W_dy + \\ B_sy*R_sy*W_dx + R_sy*W_sx*W_dy - R_sy*W_sy*W_dx \end{array}}{\begin{array}{c} B_sx*R_sy*W_dy - B_sy*R_sx*W_dy - B_sx*W_sy*W_dy + \\ B_sy*W_sx*W_dy + R_sx*W_sy*W_dy - R_sy*W_sx*W_dy \end{array}}$$

$$B_sY = \frac{\begin{array}{c} B_sy*R_sx*W_sy - B_sy*R_sy*W_sx - B_sy*R_sx*W_dy + \\ B_sy*R_sy*W_dx + B_sy*W_sx*W_dy - B_sy*W_sy*W_dx \end{array}}{\begin{array}{c} B_sx*R_sy*W_dy - B_sy*R_sx*W_dy - B_sx*W_sy*W_dy + \\ B_sy*W_sx*W_dy + R_sx*W_sy*W_dy - R_sy*W_sx*W_dy \end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Figure 6:
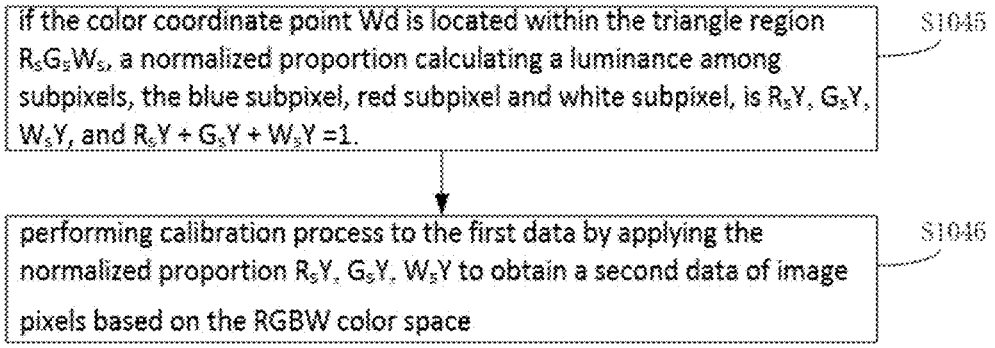
FIG. 6 is a flowchart of still another embodiment representing a method of RGBW compensation based on color aberrations of white subpixel in the present invention.

Wherein, as shown in FIG. 6, step S104 can particularly include: substep S1045 and substep S1046.

Substep S1045: if the color coordinate point $W_d$ is located within the triangle region $R_sG_sW_s$, a normalized proportion calculating a luminance among subpixels, the red subpixel, green subpixel and white subpixel, is $R_sY$, $G_sY$, $W_sY$, and $R_sY+G_sY+W_sY=1$.

Substep S1046: performing calibration process to the first data by applying the normalized proportion $R_sY$, $G_sY$, $W_sY$ to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k)$$

$$B_{fo}(k)=B_o(k)'$$

$$W_{fo}(k)=W_o(k)*W_sY(k),$$

wherein, $R_o(k)$, $G_o(k)$, $B_o(k)$, $W_o(k)$ is a first data of a pixel point k, $R_{fo}(k)$, $G_{fo}(k)$, $B_{fo}(k)$, $W_{fo}(k)$ is a second data of the pixel point k, $R_sY(k)$, $G_sY(k)$, $W_sY(k)$ is a normalized proportion of a luminance among a blue subpixel, green subpixel and white subpixel of the pixel point k.

Wherein, the normalized proportion $R_sY$, $G_sY$, $W_sY$ is obtained according to a formula 3, and the formula 3 is:

$$W_sY=\frac{R_sx*G_sy*W_sy-R_sy*G_sx*W_sy-R_sx*W_sy*W_dy+R_sy*W_sy*W_dx+G_sx*W_sy*W_dy-G_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy}$$

$$G_sY=\frac{R_sx*G_sy*W_sy-R_sy*G_sy*W_sx-R_sx*G_sy*W_dy+R_sy*G_sy*W_dx+G_sy*W_sx*W_dy-G_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy}$$

$$R_sY=\frac{R_sy*G_sx*W_sy-R_sy*G_sy*W_sx-R_sy*G_sx*W_dy+R_sy*G_sy*W_dx+R_sy*W_sx*W_dy-R_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy},$$

$$W_sY=\frac{B_sx*R_sy*W_sy-B_sy*R_sx*W_sy-B_sx*W_sy*W_dy+B_sy*W_sy*W_dx+R_sx*W_sy*W_dy-R_sy*W_sy*W_dx}{B_sx*R_sy*W_dy-B_sy*R_sx*W_dy-B_sx*W_sy*W_dy+B_sy*W_sx*W_dy+G_sx*W_sy*W_dy-R_sy*W_sx*W_dy}$$

$$R_sY=\frac{B_sx*R_sy*W_sy-B_sy*R_sy*W_sx-B_sx*R_sy*W_dy+B_sy*R_sy*W_dx+R_sy*W_sx*W_dy-R_sy*W_sy*W_dx}{B_sx*R_sy*W_dy-B_sy*R_sx*W_dy-B_sx*W_sy*W_dy+B_sy*W_sx*W_dy+R_sx*W_sy*W_dy-R_sy*W_sx*W_dy}$$

$$B_sY=\frac{B_sy*R_sx*W_sy-B_sy*R_sy*W_sx-B_sy*R_sx*W_dy+B_sy*R_sy*W_dx+B_sy*W_sx*W_dy-B_sy*W_sy*W_dx}{B_sx*R_sy*W_dy-B_sy*R_sx*W_dy-B_sx*W_sy*W_dy+B_sy*W_sx*W_dy+R_sx*W_sy*W_dy-R_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Figure 7:
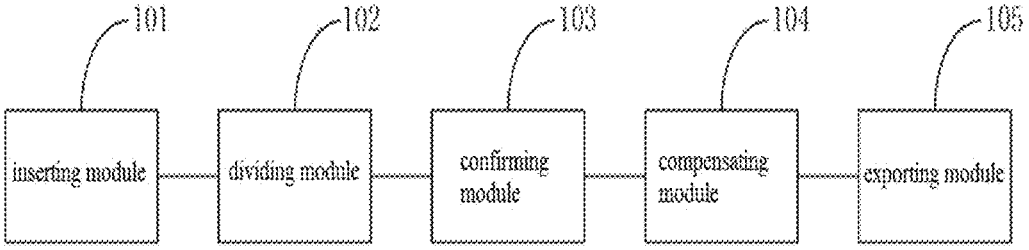
FIG. 7 is a schematic diagram showing a structure of an apparatus of an embodiment of RGBW compensation based on color aberrations of white subpixel.

Refer to FIG. 7, FIG. 7 is a schematic diagram showing a structure of an apparatus of an embodiment for compensation based on color aberrations of white subpixel; the apparatus can implementing the steps in the aforementioned method, and detail descriptions of relative contents can refer to corresponding description in the aforementioned method and will not be repeated here.

Aberrations exist between a color coordinate point $W_s$ of white subpixel of image pixels on a RGBW panel and a standard white color coordinate point $W_d$ under sRGB before compensating, and the apparatus comprises: an inserting module 101, a dividing module 102, a confirming module 103, a compensating module 104 and an exporting module 105.

The inserting module 101 is used in inserting the image pixels based on a first data of RGBW color space.

The dividing module 102 is used in analyzing color coordinates of every subpixel of the image pixels on the RGBW panel, and then dividing a triangle $R_sG_sB_s$ with vertices color coordinate points $R_s$, $G_s$ and $B_s$ of red subpixel, green subpixel and green pixel of the image points into three triangle regions, $R_sG_sW_s$, $R_sB_sW_s$, $B_sG_sW_s$, based on taking the color coordinate point $W_s$ as the center point.

The confirming module 103 is used in confirming a triangle region where the color coordinate point is located based on ranges of the three triangle regions, $R_sG_sW_s$, $R_sB_sW_s$, $B_sG_sW_s$.

The compensating module 104 is used in performing compensating the white subpixel corresponding by the center point $W_s$ via a predetermined normalized proportion to calibrate the first data through two subpixels corresponding to the other two color coordinate points, except the center point $W_s$, within the triangle region surrounding and locating the color coordinate point $W_d$.

The exporting module 105 is used in exporting the post-compensated a second data of image pixels based on the RGBW color space.

In embodiments of the present invention, when aberrations exist between a color coordinate point $W_s$ of white pixels of image pixels and a standard white color coordinate point $W_d$ under sRGB, color coordinates of every subpixel of the image pixels on the RGBW panel are analyzed, and then a triangle $R_sG_sB_s$ with vertices color coordinate points $R_s$, $G_s$ and $B_s$ of red subpixel, green subpixel and green pixel of the image points is divided into three triangle regions, $R_sG_sW_s$, $R_sB_sW_s$, $B_sG_sW_s$, based on taking the color coordinate point $W_s$ as the center point; based on ranges of the three triangle regions, $R_sG_sW_s$, $R_sB_sW_s$, $B_sG_sW_s$, a triangle region where the color coordinate point is located is confirmed; the first data is calibrated by performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$. Because the first data can be calibrated by performing compensating the white subpixel corresponding by the center point $W_s$ via a predetermined normalized proportion through two subpixels corresponding to the other two color coordinate points, except the center point $W_s$, within the triangle region surrounding and locating the color coordinate point $W_d$; therefore, the situation of aberrations of white subpixels can be calibrated specifically and further images of RGBW panels can be normalized.

Figure 8:
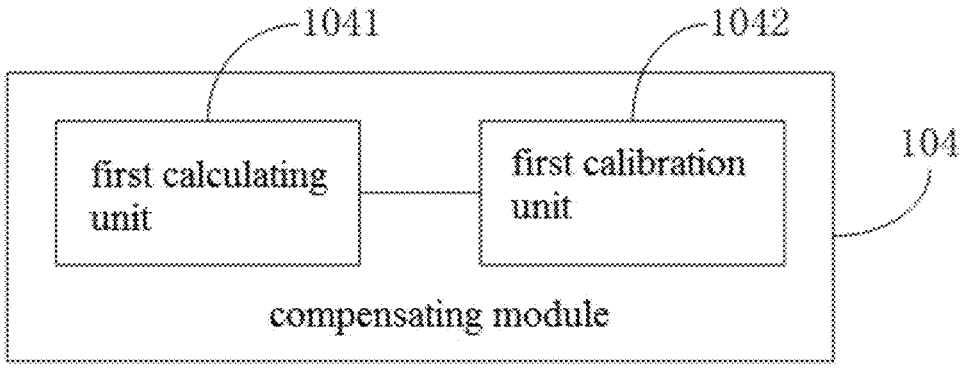
FIG. 8 is a schematic diagram showing a structure of an apparatus of another embodiment of RGBW compensation based on color aberrations of white subpixel.

Wherein, refer to FIG. 8, the compensating module 104 comprises: a first calculating unit 1041 and a first calibration unit 1042.

The first calculating unit 1041 is used in while the color coordinate point $W_d$ is located within the triangle region $B_sG_sW_s$, a normalized proportion calculating a luminance among subpixels, the blue subpixel, green subpixel and white subpixel, is $B_sY$, $G_sY$, $W_sY$, and $B_sY+G_sY+W_sY=1$.

The first calibration unit 1042 is used in performing the calibration process to the first data by applying the normalized proportion $B_sY$, $G_sY$, $W_sY$ to obtain a second data of image pixels based on the RGBW color space, $$R_{fo}(i)=R_o(i)$$

$$G_{fo}(i)=G_o(i)+W_o(i)*G_sY(i)$$

$$B_{fo}(i)=B_o(i)+W_o(i)*B_sY(i)'$$

$$W_{fo}(i)=W_o(i)*W_sY(i),$$

wherein, $R_o(i)$, $G_o(i)$, $B_o(i)$, $W_o(i)$ is a first data of a pixel point i, $R_{fo}(i)$, $G_{fo}(i)$, $B_{fo}(i)$, $W_{fo}$ (i) is a second data of the pixel point i, $B_sY(i)$, $G_sY(i)$, $W_sY(i)$ is a normalized proportion of a luminance among a blue subpixel, green subpixel and white subpixel of the pixel point i.

Wherein, the normalized proportion $B_sY$, $G_sY$, $W_sY$ is obtained according to a formula 1, and the formula 1 is:

$$W_sY=\frac{\begin{array}{c}B_sx*G_sy*W_sy-B_sy*G_sx*W_sy-B_sx*W_sy*W_dy+\\B_sy*W_sy*W_dx+G_sx*W_sy*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$G_sY=\frac{\begin{array}{c}B_sx*G_sy*W_sy-B_sy*G_sy*W_sx-B_sx*G_sy*W_dy+\\B_sy*G_sy*W_dx+G_sy*W_sx*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$B_sY=\frac{\begin{array}{c}B_sy*G_sx*W_sy-B_sy*G_sy*W_sx-B_sy*G_sx*W_dy+\\B_sy*G_sy*W_dx+B_sy*W_sx*W_dy-B_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Figure 9:
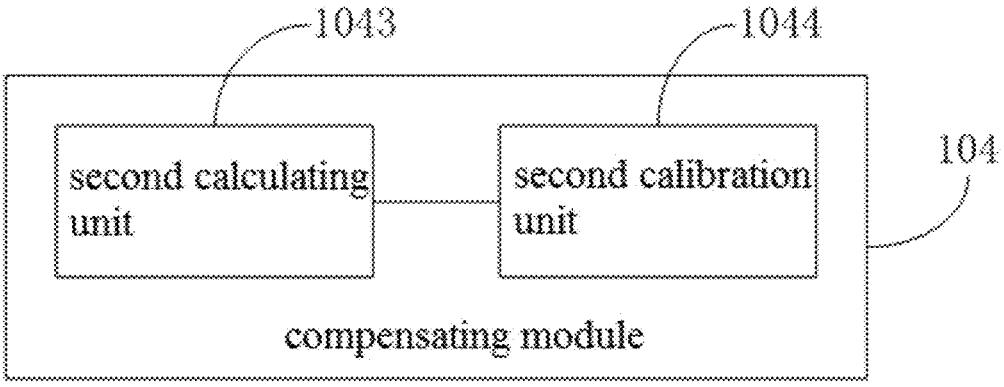
FIG. 9 is a schematic diagram showing a structure of an apparatus of still another embodiment of RGBW compensation based on color aberrations of white subpixel.

Wherein, refer to FIG. 9, the compensating module 104 comprises: a second calculating unit 1043 and a second calibration unit 1044.

The second calculating unit 1043 is used in while the color coordinate point $W_d$ is located within the triangle region $B_sR_sW_s$, a normalized proportion calculating a luminance among the blue subpixel, red subpixel and white subpixel, is $B_sY$, $R_sY$, $W_sY$, and $B_sY+R_sY+W_sY=1$.

The second calibration unit 1044 is used in performing calibration process to the first data by applying the normalized proportion $B_sY$, $R_sY$, $W_sY$ to obtain a second data of image pixels based on the RGBW color space, $$R_{fo}(j)=R_o(j)+W_o(j)*R_sY(j)$$

$$G_{fo}(j)=G_o(j)$$

$$B_{fo}(j)=B_o(j)+W_o(i)*B_sY(j)'$$

$$W_{fo}(j)=W_o(j)*W_sY(j),$$

wherein, $R_o(j)$, $G_o(j)$, $B_o(j)$, $W_o(j)$ is a first data of a pixel point j, $R_{fo}(j)$, $G_{fo}(j)$, $B_{fo}(j)$, $W_{fo}(j)$ is a second data of the pixel point j, $B_sY(j)$, $R_sY(j)$, $W_sY(j)$ is a normalized proportion of a luminance among a blue subpixel, red subpixel and white subpixel of the pixel point j.

Wherein, the normalized proportion $B_sY$, $R_sY$, $W_sY$ is obtained according to a formula 2, and the formula 2 is:

$$W_sY=\frac{\begin{array}{c}B_sx*R_sy*W_sy-B_sy*R_sx*W_sy-B_sx*W_sy*W_dy+\\B_sy*W_sy*W_dx+R_sx*W_sy*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+G_sx*W_sy*W_dy-R_sy*W_sx*W_dy\end{array}}$$

$$R_sY=\frac{\begin{array}{c}B_sx*R_sy*W_sy-B_sy*R_sy*W_sx-B_sx*R_sy*W_dy+\\B_sy*R_sy*W_dx+R_sy*W_sx*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}}$$

$$B_sY=\frac{\begin{array}{c}B_sy*R_sx*W_sy-B_sy*R_sy*W_sx-B_sy*R_sx*W_dy+\\B_sy*R_sy*W_dx+B_sy*W_sx*W_dy-B_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Figure 10:
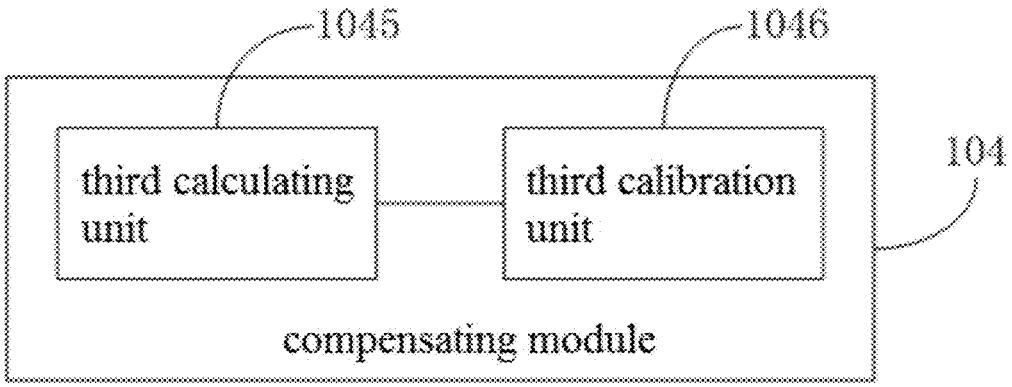
FIG. 10 is a schematic diagram showing a structure of still another apparatus of an embodiment of RGBW compensation based on color aberrations of white subpixel.

Wherein, refer to FIG. 10, the compensating module 104 comprises: a third calculating unit 1045 and a third calibration unit 1046.

The third calculating unit 1045 is used in while the color coordinate point $W_d$ is located within the triangle region $R_sG_sW_s$, a normalized proportion calculating a luminance among the red subpixel, green subpixel and white subpixel, is $R_sY$, $G_sY$, $W_sY$, and $R_sY+G_sY+W_sY=1$.

The third calibration unit 1046 is used in performing calibration process to the first data by applying the normalized proportion $R_sY$, $G_sY$, $W_sY$ to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k)$$

$$B_{fo}(k)=B_o(k)'$$

$$W_{fo}(k)=W_o(k)*W_sY(k),$$

wherein, $R_o(k)$, $G_o(k)$, $B_o(k)$, $W_o(k)$ is a first data of a pixel point k, $R_{fo}(k)$, $G_{fo}(k)$, $B_{fo}(k)$, $W_{fo}(k)$ is a second data of the pixel point k, $R_sY(k)$, $G_sY(k)$, $W_sY(k)$ is a normalized proportion of a luminance among a red subpixel, green subpixel and white subpixel of the pixel point k.

Wherein, the normalized proportion $R_sY$, $G_sY$, $W_sY$ is obtained according to a formula 3, and the formula 3 is:

$$W_sY = \frac{R_sx*G_sy*W_sy - R_sy*G_sx*W_sy - R_sx*W_sy*W_dy + R_sy*W_sy*W_dx + G_sx*W_sy*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$G_sY = \frac{R_sx*G_sy*W_sy - R_sy*G_sy*W_sx - R_sx*G_sy*W_dy + R_sy*G_sy*W_dx + G_sy*W_sx*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$R_sY = \frac{R_sy*G_sx*W_sy - R_sy*G_sy*W_sx - R_sy*G_sx*W_dy + R_sy*G_sy*W_dx + R_sy*W_sx*W_dy - R_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy},$$

wherein, $(B_sx,B_sy)$ is a coordinate of a coordinate point of blue subpixel of a pixel point, $(G_sx,G_sy)$ is a coordinate of a coordinate point of green subpixel of the pixel point, $(W_sx,W_sy)$ is a coordinate of a coordinate point of white subpixel of the pixel point, and $(W_dx,W_dy)$ is a coordinate of a standard white color coordinate point under sRGB.

Even though information and the advantages of the present embodiments have been set forth in the foregoing description, together with details of the mechanisms and functions of the present embodiments, the disclosure is illustrative only; and that changes may be made in detail, especially in matters of shape, size and arrangement of parts within the principles of the present embodiments to the full extend indicated by the broad general meaning of the terms in which the appended claims are expressed.

The invention claimed is:

1. A method of RGBW compensation based on a color aberration of a white subpixel, wherein color aberration exists between a color coordinate point Ws of the white subpixel of an image pixel on a RGBW panel defined in a RGBW color space and a standard white color coordinate point Wd in an sRGB system before compensating, the method comprising the following steps:

supplying first data of the image pixel defined in the RGBW color space, which includes color coordinates of each of a red subpixel, a blue subpixel, a green subpixel, and a white subpixel of the image pixel on the RGBW panel and respectively define a red color coordinate point Rs, a blue color coordinate point Bs, a green color coordinate point Gs and the white color coordinate point Ws in the RGBW color space;

processing the color coordinates of the red, blue, green, and while subpixels of the image pixel on the RGBW panel to define a triangle RsGsBs with vertices being defined by the color coordinate points Rs, Gs, and Bs of the red subpixel, the green subpixel and the green pixel of the image pixel, the triangle being divided into three triangular regions, which are respectively defined as a first triangular region RsGsWs, a second triangular region GsBsWs, and a third triangular region BsRsWs, having vertices respectively defined by the red, green, and white color coordinate points Rs, Gs, Ws; the green, blue, and white color coordinate points Gs, Bs, Ws; and the blue, red, and white color coordinate points Bs, Rs, Ws, with the white color coordinate point Ws as a center point;

determining one of the three triangular regions, RsGsWs, GsBsWs, and BsRsWs, where the standard color coordinate point Wd is located, wherein the three vertices of the one of the three triangular regions include the center point Ws and two outer points, which are two of the red, green, and blue color coordinate points Rs, Gs, Bs;

compensating the white subpixel by applying a predetermined normalized proportion operation to the first data of the color coordinates corresponding to the two outer points of the one of the three triangular regions in order to correct the first data to form second data of the image pixel;

outputting the second data of the image pixel based on thr RGBW color space;

wherein the predetermined normalized proportion operation is carried out as follows:

when the one of the three triangular regions in which the standard white color coordinate point Wd is located is the triangular region GsBsWs, calculating a normalized proportion of luminance among the blue subpixel, green subpixel and white subpixel as BsY, GsY, WsY, wherein BsY+GsY+WsY=1;

applying the normalized proportion BsY, GsY, WsY to correct the first data to obtain the second data of the image pixel based on the RGBW color space, where $$Rfo(i)=Ro(i),$$

$$Gfo(i)=Go(i)+Wo(i)*GsY(i),$$

$$Bfo(i)=Bo(i)+Wo(i)*BsY(i), \text{ and}$$

$$Wfo(i)=Wo(i)*WsY(i),$$

wherein Ro(i), Go(i), Bo(i), and Wo(i) are the first data of a pixel point i, Rfo(i), Gfo(i), Bfo(i), and Wfo(i) are the second data of the pixel point i, BsY(i), GsY(i), and WsY(i) represent the normalized proportion of luminance among the blue subpixel, the green subpixel and the white subpixel of the pixel point i;

alternatively, when the one of the three triangular regions in which the standard white color coordinate point Wd is located is the triangular region BsRsWs, calculating a normalized proportion of luminance among the blue subpixel, red subpixel and white subpixel as BsY, RsY, WsY wherein BsY+RsY+WsY=1;

applying the normalized proportion BsY, RsY, WsY to correct the first data to obtain the second data of the image pixel based on the RGBW color space, where $$Rfo(j)=Ro(j)+Wo(j)*RsY(j),$$

$$Gfo(j)=Go(j),$$

$$Bfo(j)=Bo(j)+Wo(j)*BsY(j), \text{ and}$$

$$Wfo(j)=Wo(j)*WsY(j),$$

wherein Ro(j), Go(j), Bo(j), and Wo(j) are the first data of a pixel point j, Rfo(j), Gfo (j), Bfo(j), and Wfo(j) are the second data of the pixel point j, BsY(j), GsY(j), and WsY(j) represent the normalized proportion of luminance among the blue subpixel, the red subpixel and the white subpixel of the pixel point j;

alternatively, when the one of the three triangular regions in which the standard white color coordinate point Wd is located is the triangular region RsGsWs, calculating a normalized proportion of luminance among the red subpixel, green subpixel and white subpixel as RsY, GsY, WsY wherein RsY+GsY+WsY=1;

applying the normalized proportion RsY, GsY, WsY to correct the first data to obtain the second data of the image pixel based on the RGBW color space, where $Rfo(k)=Ro(k)+Wo(k)*RsY(k)$, $Gfo(k)=Go(k)+Wo(k)*GsY(k)$, $Bfo(k)=Bo(k)$, and $Wfo(k)=Wo(k)*WsY(k)$, wherein Ro(k), Go(k), Bo(k), and Wo(k) are the first data of a pixel point k, Rfo(k), Gfo(k), Bfo(k), and Wfo(k) are the second data of the pixel point k, RsY(k), GsY(k), and WsY(k) represent the normalized proportion of luminance among the red subpixel, the green subpixel and the white subpixel of the pixel point k.

2. The method according to claim 1, wherein the normalized proportion of luminance among the blue subpixel, green subpixel and white subpixel, BsY, GsY, WsY, is obtained according to the following formula:

$$W_sY = \frac{B_sx*G_sy*W_sy - B_sy*G_sx*W_sy - B_sx*W_sy*W_dy + B_sy*W_sy*W_dx + G_sx*W_sy*W_dy - G_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

$$G_sY = \frac{B_sx*G_sy*W_sy - B_sy*G_sy*W_sx - B_sx*G_sy*W_dy + B_sy*G_sy*W_dx + G_sy*W_sx*W_dy - G_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

$$B_sY = \frac{B_sy*G_sx*W_sy - B_sy*G_sy*W_sx - B_sy*G_sx*W_dy + B_sy*G_sy*W_dx + B_sy*W_sx*W_dy - B_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

wherein (Bsx, Bsy) are coordinates of the blue color coordinate point Bs, (Gsx, Gsy) are coordinates of the green color coordinate point Gs, (Wsx, Wsy) are coordinates of the white color coordinate point, and (Wdx, Wdy) are coordinates of the standard white color coordinate point under the sRGB system.

3. The method according to claim 1, wherein the normalized proportion of luminance among the blue subpixel, red subpixel and white subpixel, BsY, RsY, WsY, is obtained according to the following formula:

$$W_sY = \frac{B_sx*R_sy*W_sy - B_sy*R_sx*W_sy - B_sx*W_sy*W_dy + B_sy*W_sy*W_dx + R_sx*W_sy*W_dy - R_sy*W_sy*W_dx}{B_sx*R_sy*W_dy - B_sy*R_sx*W_dy - B_sx*W_sy*W_dy + B_sy*W_sx*W_dy + G_sx*W_sy*W_dy - R_sy*W_sx*W_dy}$$

-continued $$R_sY = \frac{B_sx*R_sy*W_sy - B_sy*R_sy*W_sx - B_sx*R_sy*W_dy + B_sy*R_sy*W_dx + R_sy*W_sx*W_dy - R_sy*W_sy*W_dx}{B_sx*R_sy*W_dy - B_sy*R_sx*W_dy - B_sx*W_sy*W_dy + B_sy*W_sx*W_dy + R_sx*W_sy*W_dy - R_sy*W_sx*W_dy}$$

$$B_sY = \frac{B_sy*R_sx*W_sy - B_sy*R_sy*W_sx - B_sy*R_sx*W_dy + B_sy*R_sy*W_dx + B_sy*W_sx*W_dy - B_sy*W_sy*W_dx}{B_sx*R_sy*W_dy - B_sy*R_sx*W_dy - B_sx*W_sy*W_dy + B_sy*W_sx*W_dy + R_sx*W_sy*W_dy - R_sy*W_sx*W_dy}$$

wherein (Bsx, Bsy) are coordinates of the blue color coordinate point Bs, (Rsx, Rsy)are coordinates of the red color coordinate point Rs, (Wsx, Wsy) are coordinates of the white color coordinate point, and (Wdx, Wdy) are coordinates of the standard white color coordinate point under the sRGB system.

4. The method according to claim 1, wherein the normalized proportion of luminance among the red subpixel, green subpixel and white subpixel, RsY, GsY, WsY, is obtained according to the following formula:

$$W_sY = \frac{R_sx*G_sy*W_sy - R_sy*G_sx*W_sy - R_sx*W_sy*W_dy + R_sy*W_sy*W_dx + G_sx*W_sy*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$G_sY = \frac{R_sx*G_sy*W_sy - R_sy*G_sy*W_sx - R_sx*G_sy*W_dy + R_sy*G_sy*W_dx + G_sy*W_sx*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$R_sY = \frac{R_sy*G_sx*W_sy - R_sy*G_sy*W_sx - R_sy*G_sx*W_dy + R_sy*G_sy*W_dx + R_sy*W_sx*W_dy - R_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

wherein (Rsx, Rsy) are coordinates of the red color coordinate point Rs, (Gsx, Gsy) are coordinates of the green color coordinate point Gs, (Wsx, Wsy) are coordinates of the white color coordinate point, and (Wdx, Wdy) are coordinates of the standard white color coordinate point under the sRGB system.

* * * * *